US006062557A

United States Patent [19]

Kusumi

[11] Patent Number: 6,062,557

[45] Date of Patent: May 16, 2000

[54] IMAGE FORMING APPARATUS HAVING A NON-EXCITING ACTUATE TYPE ELECTROMAGNETIC CLUTCH

[75] Inventor: Tadashi Kusumi, Yokohama, Japan

[73] Assignee: Ricoh Company, Ltd., Tokyo, Japan

[21] Appl. No.: 09/034,325

[22] Filed: Mar. 4, 1998

[30] Foreign Application Priority Data

Mar. 4, 1997 [JP] Japan ..... 9-049116

[51] Int. Cl.[7] ..... B65H 5/00

[52] U.S. Cl. ..... 271/10.13; 271/9.13; 271/265.01; 271/266; 271/272

[58] Field of Search ..... 271/10.04, 10.05, 271/10.11, 10.12, 10.13, 116, 115, 9.13, 242, 272, 265.01, 266; 192/84.31

[56] References Cited

U.S. PATENT DOCUMENTS

| | | | |
|---|---|---|---|
| 3,263,784 | 8/1966 | Pierce | 192/84.31 |
| 4,496,922 | 1/1985 | Pardee | 192/84.31 |
| 4,565,360 | 1/1986 | Runzi | 271/116 |
| 4,645,192 | 2/1987 | Watanabe | 271/10.13 |
| 5,140,364 | 8/1992 | Nakayama | 271/9.13 |
| 5,199,694 | 4/1993 | Iseda | 271/242 |

FOREIGN PATENT DOCUMENTS

| | | | |
|---|---|---|---|
| 361243752 | 10/1986 | Japan | 271/9.13 |
| 62-51533 | 3/1987 | Japan . | |
| 0147738 | 6/1988 | Japan | 271/242 |
| 0036132 | 2/1991 | Japan | 271/242 |
| 403264430 | 11/1991 | Japan | 271/10.13 |

*Primary Examiner*—H. Grant Skaggs
*Attorney, Agent, or Firm*—Oblon, Spivak, McClelland, Maier & Neustadt, P.C.

[57] ABSTRACT

An image forming apparatus including a sheet feeding device that is driven by a driving device through an interval device. The interval device can transfer the driving force only when a coil in the interval device is not electrified. Accordingly, when the feeding device is in active condition, the coil and the interval device do not become hotter and sheet feeding becomes more reliable.

17 Claims, 5 Drawing Sheets

IMAGE FORMING APPARATUS HAVING A NON-EXCITING ACTUATE TYPE ELECTROMAGNETIC CLUTCH

BACKGROUND OF THE INVENTION

1. Field of the Invention

The present invention relates to an image forming apparatus, e.g., a digital copier or a facsimile device. The image forming apparatus includes a feeding device having a transferring and release mechanism for a driving force. The feeding device is located upstream of registry rolls and located downstream of a sheet supplying and separating part in the sheet conveyance direction.

2. Discussion of the Background

In image forming apparatuses (e.g., electrostatic copying machines, printers, and facsimiles) that expand image data to form images based on a difference of the expanding period in each image data, a sheet conveyed to registry rolls remains there for a time corresponding to the expanding period. Then the sheet is conveyed synchronously with the writing action. While a sheet stops at the registry rolls, a sheet feeding device located downstream of a sheet supplying and separating part must stop feeding the next sheet.

In a conventional image forming apparatus, an electromagnetic clutch located between the registry rolls and the sheet supplying/separating part is used to transfer and release a driving force to the feeding device. When the clutch transfers the driving force to the feeding device, a coil equipped in the clutch is electrically energized. When the clutch releases the driving force, no electrical power is applied to the coil.

In recent years, as demand for higher speed printers and digital copiers has increased, sheet feeding speed has become higher and the space between sheets has narrowed. As the space between sheets has narrowed, the stopping period of the sheet feeding device has been reduced to the above-mentioned expanding time for the image data.

The expanding time is relatively short (about 1.5 seconds) except in peculiar cases. Accordingly, the clutch of the sheet feeding means becomes active for long durations. The coil, as a result becomes hotter which causes a static frictional torque of the electromagnetic clutch to decrease. As a result, the electromagnetic clutch can become faulty which causes miss-feeding of the sheet and the sheet is more easily jammed.

Further, when an image forming apparatus has plural sheet feeding devices and the distance between the sheet feeding devices and the registry is long, in order to resolve a jam condition with a single lever, driving loops coupled to each sheet feeding device are required to move all the sheet feeding devices.

Thus, the electromagnetic clutch is required to have a capacity that can transfer a driving force from the lever to the all the driving loops. When a load torque of the electromagnetic clutch from the lever is high or when the sheet supplying/separating device is united with the sheet feeding device, plural clutches and other driving loops specially designed to resolve sheet feeding jams are required. The addition of these components increases the cost of the apparatus.

SUMMARY OF THE INVENTION

Accordingly, one object of this invention is to provide a novel image forming apparatus that can feed a sheet reliably.

Another object of this invention is to provide a novel image forming apparatus having a clutch that does not cause the coil to overheat even when the stopping period of the sheet feeding device is short.

Still another object of this invention is to provide a novel image forming apparatus having a driving mechanism for resolving sheet feeding jams without increasing costs or complexity.

These and other objects of the present invention are achieved by providing a new and improved apparatus wherein an image forming apparatus has a sheet supplying device which supplies a sheet and registry rolls which control the timing of the transportation of the sheet to an image formed in an imaging forming area. A sheet feeding device having a roller and a shaft feeds the sheet fed from the sheet supplying device to the registry rolls through a conveyance pass. A non-exciting active electromagnetic type clutch arranged at an end of the shaft transfers driving power from a driving device to the sheet feeding device only when the clutch is not electrified.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
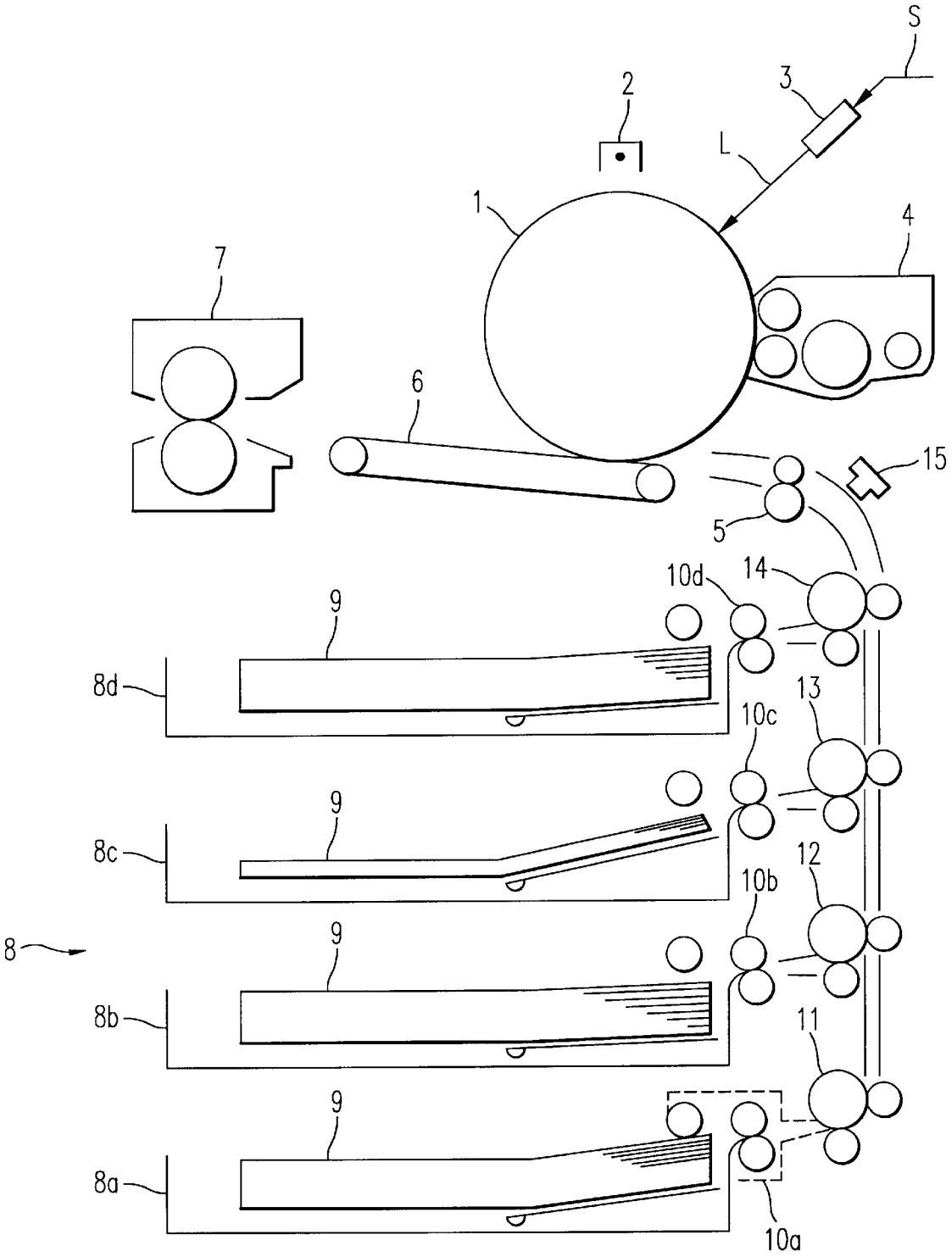
FIG. 1 is a schematic illustration of a copy machine according to a first embodiment of the present invention.

Referring now to the drawings, wherein like reference numerals designate identical or corresponding parts throughout the several views, and more particularly to FIG. 1 thereof, a copy machine has a photosensitive drum 1. A charging device 2, an exposure device 3, a developing device 4, and a transcription/conveyance device (transcription belt) 6 are arranged around the drum 1. A cleaning device and an eraser lump (not shown) are also arranged around the drum. Registry rolls 5 are arranged upstream of the transcription device 6 in a sheet feeding direction. A fixing device 7 is arranged downstream of the transcription device 6. There are four tiered sheet trays 8. Sheet bundles 9 are loaded in them. Feeding rollers 11, 12, 13, 14 are arranged between corresponding sheet supplying/separating rollers 10*a*, 10*b*, 10*c*, 10*d*, which are adjacent to each of the trays 8*a*, 8*b*, 8*c*, 8*d*, and the registry rolls 5. A registry sensor 15 is arranged upstream near the registry rolls 5. An image signal corresponding to the image that is to print to a sheet is supplied to a image processor to be extended, and then the image signal is supplied in the exposure device 3 as a drive signal S. The exposure device 3 has a laser generator (not shown) moderated by the drive signal S and a polygonal mirror for polarizing laser light L generated by the laser generator and for scanning on the photosensitive drum 1 charged by the charging device 2. When the laser light L emitted from the exposure device 3 leaves irradiation (a write) on the surface of the photosensitive drum 1, an electrical latent image is formed on the surface of the photosensitive drum 1. The electrical latent image formed on the photosensitive drum 1 changes toner image passing through developing process by the developing device 4. The toner image then is transferred to a sheet conveyed to the transcription/conveyance device 6 and adjusted a timing by the registry rolls 5. Then, the toner image on the sheet is fixed by the fixing device 7, and the sheet is ejected to the eject department (now shown).

Next, the movement of an individual sheet from the supplying/separating rollers 10*a* to the registry rolls 5 will be explained. A bundle of sheets 9 loaded on the sheet tray 8*a* is divided by the sheet supplying/separating rollers 10*a*, which may be an FRR (frictional reverse roller) paper supply system, and only one sheet is sent to the feeding roller 11. The sheet is conveyed by feeding rollers 12, 13, and 14 successively. The sheet passes the registry sensor 15 and comes to the registry rolls 5 which are at rest.

To sag the sheet between the registry rolls 5 and the sheet feeding roller 14, the sheet feeding rollers 11, 12, 13, 14 are stopped for a predetermined-period after a front-edge of the sheet passes through the registry sensor 15. In this manner, the edge of the sheet is squared up.

When the copy machine is continuously printing, the feeding rollers 11, 12, 13, 14, and the supplying/separating rollers 10*a*, 10*b*, 10*c*, 10*d* stop rolling (transferring the sheet or the following sheet) to prevent the first sheet and the following sheet from colliding. In this situation, the first sheet stays in contact with the registry rolls 5. The registry rolls 5 begin rolling after an amount of time that is based on the toner image and that is varied in relation to the image expansion on the photosensitive drum 1.

The feeding rollers 11, 12, 13, 14 also start rolling when the registry rolls begin rolling. Accordingly, the following sheet will stop at the registry part, and this sheet will be transferred in the same manner as the first sheet.

Figure 2:
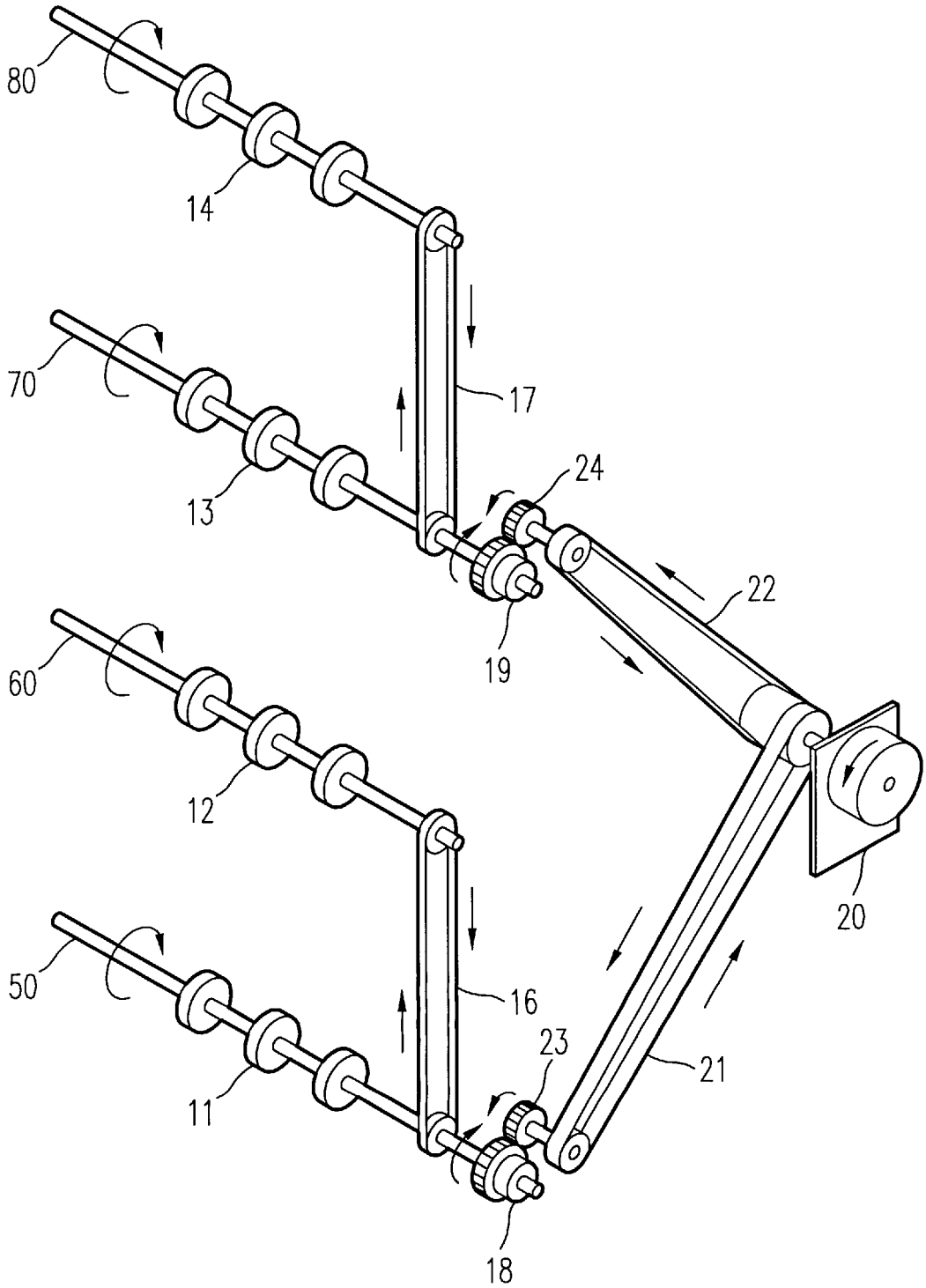
FIG. 2 is an illustration of a driving mechanism for sheet feeding rollers according to a first embodiment of the present invention.

FIG. 2 shows the driving mechanism for the sheet feeding rollers according to one embodiment of the present invention.

Shafts 50 and 60 of the feeding rollers 11 and 12 are each connected by a timing belt 16. Shafts 70 and 80 of the feeding rollers 13 and 14 similarly are each connected by a timing belt 17.

A non-exciting actuate type electromagnetic clutch 18 is arranged at an end of the shaft 50 of the feeding roller 11, and a driving force input through a belt loop 21 and an input gear 23 from a motor 20 is transferred to move the feeding rollers 11 and 12 when needed. Likewise, a non-exciting actuate type electromagnetic clutch 19 is arranged at an end of the shaft 70 of the feeding roller 13, and a driving force from a motor 20 input through a belt loop 22 and an input gear 24 is transferred to move the feeding rollers 13 and 14 when needed.

Figure 4:
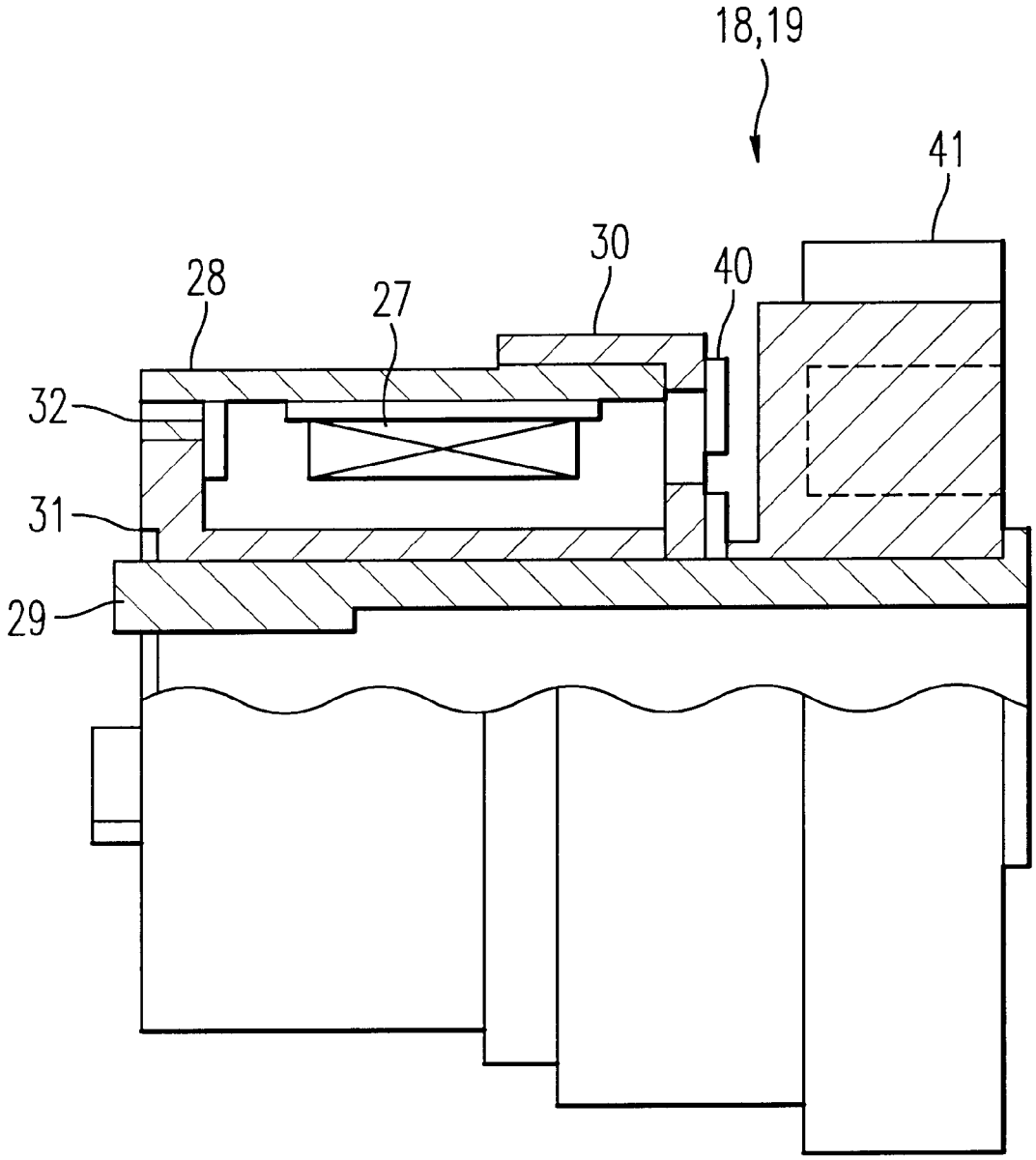
FIG. 4 is a cross sectional illustration of a non-exciting actuate type electromagnetic clutch when a coil is not energized.
Figure 5:
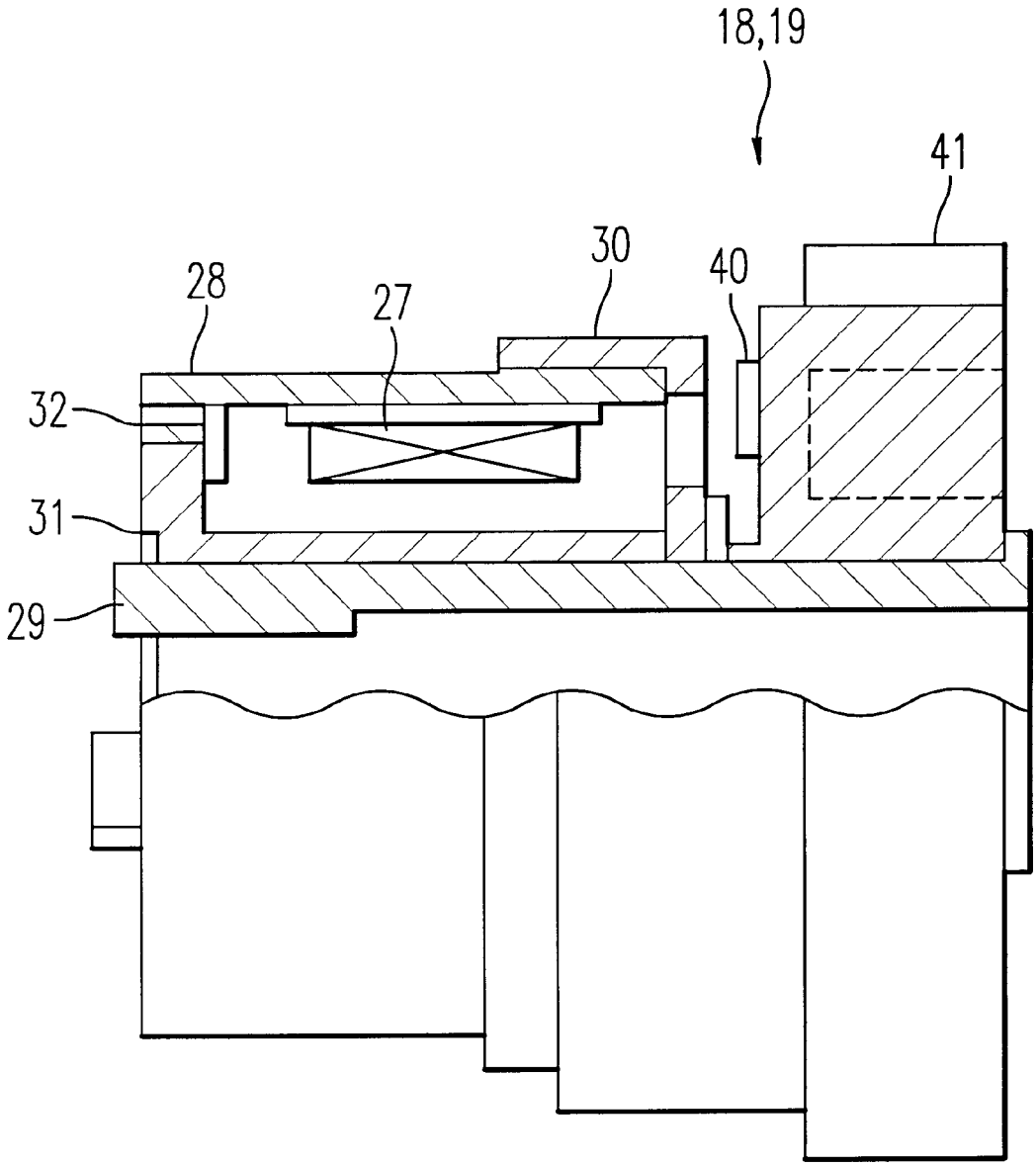
FIG. 5 is a cross sectional illustration of a non-exciting actuate type electromagnetic clutch when a coil is energized.

The non-exciting actuate type electromagnetic clutches 18 and 19 will now be explained. As shown in FIG. 4 and FIG. 5, an exciting coil 27 and an outer side yoke 28 made of a magnetic substance are arranged on a fixed side. A hollow shaft 29, a rotor 30, and a inside yoke 31 are arranged on a turn side. A permanent magnet 32 is arranged on either end face of a magnetic gap between the outer side yoke 28 of the fixed side and the inside yoke 31 of the turn side. Alternatively, the permanent magnet 32 can be arranged on either end face of a magnetic gap between the outer side yoke 28 of the fixed side and the rotor 30 of the turn side.

When the coil 27 of the non-exciting actuate type electromagnetic clutch 18 is not energized, a magnetic path is formed between the permanent magnet 32 of the output side and a plate 40 of the input side (shown in FIG. 4) which is drawn to the output side by the magnetic force. As a result, and the driving force from the motor 20 is transferred to the shaft 50 of the feeding roller 11 through a gear 41.

Conversely, when the coil 27 of the non-exciting actuate type electromagnetic clutch 18 is energized, a reverse magnetic path is formed between the permanent magnet 32 of the output side and the plate 40 of the input side, and the magnetic force cancels the magnetic force of the permanent magnet 32. Therefore, the force which draws the plate 40 is not generated. In synergy with the action of a reverse spring (not shown), the plate 40 is released (shown in FIG. 5), and the power transfer from the motor 20 is cut off.

Consequently, since the current ratio of the clutches 18 and 19 is opposite the current ratio of conventional electromagnetic clutches, when the stopping period of the feeding roller shortens (for example, when a space between a first sheet and a following sheet fed is narrow), the current ratio can decrease, and it is possible to prevent the clutches 18 and 19 and the respective coils 27 from rising in temperature.

By setting the load torque of the power train lower than the static frictional torque of the non-exciting actuate type electromagnetic clutches 18 and 19, it is possible to rotate the feeding rollers 11,12,13,14 by a rotation of only one feeding roller 13 under non-current status in the coil 27.

In this embodiment, as the coils in the clutches 18 and 19 are not raised when the feeding rollers 11,12,13,14 rotate by the driving force of the motor 20, it is possible to feed sheets more reliably. It becomes particularly advantageous to use this configuration in an image forming apparatus having a sheet feeding device with a short waiting time of a sheet at the registry rolls or in an image forming apparatus having a sheet feeding device with a feeding roller having a short stopping period.

Figure 3:
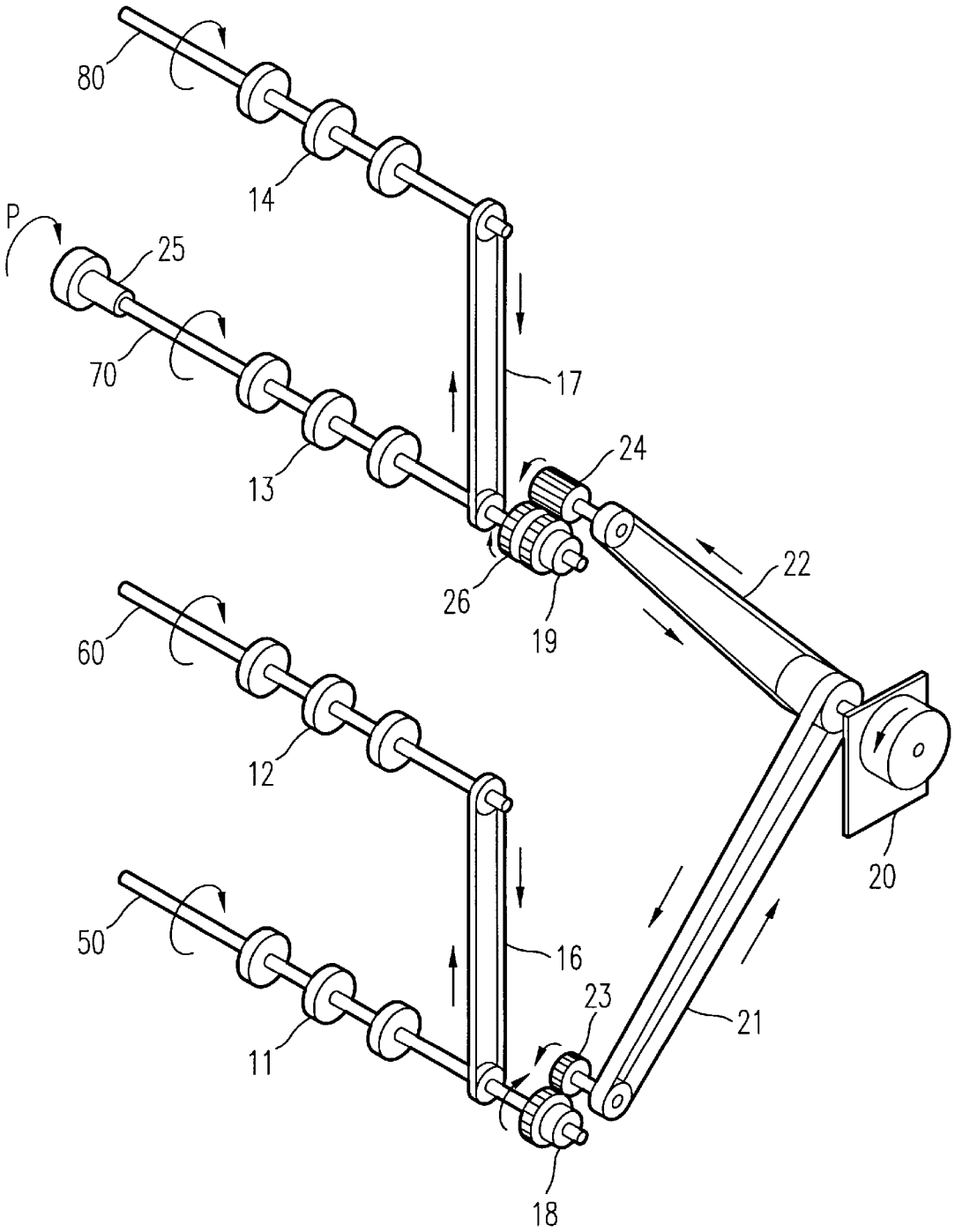
FIG. 3 is an illustration of a driving mechanism for sheet feeding rollers according to a second embodiment of the present invention.

FIG. 3 shows a driving mechanism for the sheet feeding rollers 1 1, 12, 13, 14 according to a second embodiment of the present invention.

Shafts 50 and 60 of the feeding rollers 11 and 12 are connected by a timing belt 16. Similarly, shafts 70 and 80 of the feeding rollers 13 and 14 are connected by a timing belt 17. A non-exciting actuate type electromagnetic clutch 18 is arranged at an end of the shaft 50 of the feeding roller 11. A driving force is input from a motor 20 through a belt loop 21 and an input gear 23 which is meshed with the gear of the clutch 18, and the driving force is transferred to move the feeding rollers 11 and 12 when needed. Similarly, a non-exciting actuate type electromagnetic clutch 19 is arranged at an end of a shaft 70 of the feeding roller 13. A driving force is input from a motor 20 through a belt loop 22 and a gear 24 which is meshed with the gear of the clutch 19, and the driving force is transferred to move the feeding rollers 13 and 14 when needed.

A knob 25 for rotating the feeding roller 13 manually is provided on an end of the shaft 70 opposite the clutch 19 to send and remove a sheet in a removal direction when a sheet feeding jam is present.

A one-way clutch 26 for transferring a large torque from the shaft 70 is arranged in the vicinity of the clutch 19, and the one-way clutch 26 is rotated with the shaft 70 by the rotation of the knob 25 in a direction P to remove the jammed sheet. Teeth of the gear of the one-way clutch 26 are shaped the same as the teeth from the gear of the non-exciting actuate type electromagnetic clutch 19. The gear of the one-way clutch 26 is also meshed with the gear 24.

In above mentioned construction, when the knob 25 is rotated manually in the direction of the arrow P when a sheet feeding jam has occurred in the path of the feeding roller 11, the shaft 70 of the feeding roller 13 is rotated and the gear of the non-exciting actuate type electromagnetic clutch 19 (that is in non-exciting condition) transfers a torque from the knob 25 to the gear 24. Likewise, the gear of the one-way clutch 26 also transfers a torque from the knob 25 to the gear 24.

By setting the deceleration ratio of the motor 20 low (a 5:1 ratio may suitable), it is possible to rotate a rotor of the motor 20 only by a rotational force from the knob 25 through the shaft 70, the gear 24, and the belt loop 22. Accordingly, the feeding roller 11 can be rotated to remove the jammed sheet by the rotational force of the knob 25 by successively transferring the torque from the knob 25 through the shaft 70, the gear 24, the belt loop 22, the belt loop 21, and the gear 23.

If the knob 25 is rotated in the direction opposite the direction P, the feeding roller 13 is rotated in a direction opposite the sheet feeding direction. The force of the rotation of the knob 25 cannot transfer to the gear 24 through the one-way clutch 26 and can only transfer through the non-exciting actuate type electromagnetic clutch 19. When the static friction torque of the non-exciting actuate type electromagnetic clutch 19 is smaller than the load torque of the powertrain, the rotor 30 of the non-exciting actuate type electromagnetic clutch 19 slips against the plate 40 (FIG. 4) of the non-exciting actuate type electromagnetic clutch 19. Therefore, the power transfer from the knob 25 stops. Accordingly, as the feeding rollers 11, 12, 14 can not be rotated in the direction opposite to the removal direction, the jammed condition of the jammed sheet is not worsened if an operator carelessly rotates the knob 25 in the reverse direction.

In an area near the feeding roller 13, a space for handling the jammed sheet may be provided. The space can prevent the jam from becoming worse.

The sheet removing direction is generally the same as the normal direction of sheet conveyance. Feeding jammed sheets in the reverse direction makes the jam worse when a new sheet is unexpectedly fed.

In the second embodiment, it is not necessary to keep spaces for handling jammed sheets in proximity to the feeding rollers 11, 12, 14 as these feeding rollers cannot be rotated in the reverse direction. Further, the driving loops specially designed to remove jammed sheets required in machines having conventional electromagnetic clutches are not required in the present invention. These features contribute to cost-reduction of the copy machine.

Still further, as each non-exciting actuate type electromagnetic clutch is set only to have a torque ability that can feed the sheet by courtesy of the one-way clutch, the static frictional value of the clutches is kept low. This also reduces the cost of the copy machine.

In an alternative arrangement of the second embodiment, a one-way clutch transferring the force of the knob 25 only in the direction to remove the jammed sheet to the shaft 70 is set in a operating part of the knob 25 and the shaft 70. In this arrangement, the jammed sheet can be removed only when an operator rotates the knob 25 in the removal direction. On the other hand, when an operator rotates the knob 25 in the reverse direction, the knob 25 freewheels and the condition of the jammed sheet is not made worse in the feeding rollers 11, 12, 13, 14. Further, as slip between the rotor and the plate is not caused by reverse rotation, deterioration of their contacting faces is decreased.

The above mentioned embodiments of the invention are explained as they might be incorporated in a copy machine. However, the teachings of the present invention can apply to other image forming apparatuses such as a printer.

Obviously, numerous modifications and variations of the present invention are possible in light of the above teachings. It is therefore to be understood that within the scope of the appended claims, the invention may be practiced otherwise than as specifically described herein.

This application is based on Japanese patent application no. 09-049116 which is incorporated by reference herein.

What is claimed is:

1. An image forming apparatus comprising:

image forming means;

sheet supplying means for supplying a sheet to the image forming means;

timing means for timing a transportation of the sheet to the image forming means;

sheet feeding means for feeding the sheet fed from the sheet supplying means to the timing means through a conveyance pass;

driving means for driving the sheet feeding means; and a first driving power transferring means including an exciting coil, for transferring the driving power from the driving means to the sheet feeding means only when electrical power is not supplied to the exciting coil.

2. An image forming apparatus according to claim 1, wherein said sheet feeding means comprises:

a shaft;

a knob set at a end of the shaft and configured to be rotated manually to remove a jammed sheet; and a second driving power transferring means having a one-way clutch located between the shaft and an input part of the driving means for transferring a torque generated from the knob to the input part only when the knob is rotated in one direction.

3. An image forming apparatus according to claim 2, wherein the sheet feeding direction when the knob is rotated in said one direction is the same as the sheet feeding direction under a normal condition in the sheet feeding means.

4. An image forming apparatus according to claim 2, further comprising:

a one-way clutch that transfers the torque generated from the knob to the shaft when the knob is rotated in a first direction and does not transfer the power generated from the knob to the shaft when the knob is rotated in a second direction opposite of said first.

5. An image forming apparatus according to claim 2, further comprising:

accommodating means for accommodating sheets, wherein the sheet feeding means contacts the accommodating means.

6. An image forming apparatus comprising:

image forming means;

sheet supplying means for supplying a sheet to the image forming means;

a registry sensor for timing a transportation of the sheet to the image forming means;

sheet feeding means having a roller and a shaft for feeding the sheet fed from the sheet supplying means to the registry sensor through a conveyance pass;

driving means having a motor and a first gear for driving the sheet feeding means; and a clutch arranged at an end of the shaft and including an exciting coil, for transferring the driving power from the driving means to the sheet feeding means only when electrical power is not supplied to the exciting coil, wherein the clutch comprises a second gear meshing with said first gear of the driving means.

7. An image forming apparatus according to claim 6, wherein said sheet feeding means comprises:

a knob set at the other end of the shaft and rotated manually to remove a jammed sheet; and a third gear having an one-way clutch arranged between the shaft and the first gear of the driving means for transferring a power generated from the knob to the first gear only when the knob is rotated in a first direction.

8. An image forming apparatus according to claim 7, wherein the sheet feeding direction, when the knob is rotated in said one direction, is the same as the sheet feeding direction under a normal condition of the sheet feeding means.

9. An image forming apparatus according to claim 7, further comprising:

a one-way clutch that transfers the power generated from the knob to the shaft when the knob is rotated in a first direction and does not transfer the power generated from the knob to the shaft when the knob is rotated in a second direction opposite the first direction.

10. An image forming apparatus in accordance with claim 7, further comprising:

a tray for accommodating sheets, wherein the sheet feeding means contacts the tray.

11. An image forming apparatus comprising:

an image forming section;

a sheet supplying device which supplies a sheet to the image forming section;

a timing device which times a transportation of the sheet to the image forming section;

a sheet feeding device which feeds the sheet fed from the sheet supplying device to the timing device through a conveyance pass;

a driving device which drives the sheet feeding device; and a first driving power transferring device including an exciting coil and configured to transfer the driving power from the driving device to the sheet feeding device only when electrical power is not supplied to the exciting coil.

12. An image forming apparatus according to claim 11, wherein said sheet feeding device comprises:

a shaft;

a knob on an end of the shaft configured to be rotated manually to remove a jammed sheet; and a second driving power transferring device comprising a one-way clutch located between the shaft and an input part of the driving device for transferring a torque generated from the knob to the input part only when the knob is rotated in one direction.

13. An image forming apparatus according to claim 12, wherein the sheet feeding direction when the knob is rotated in said one direction is the same as the sheet feeding direction under a normal condition in the sheet feeding device.

14. An image forming apparatus according to claim 12, further comprising:

a one-way clutch that transfers the torque generated from the knob to the shaft when the knob is rotated in a first direction and does not transfer the power generated from the knob to the shaft when the knob is rotated in a second direction opposite of said first direction.

15. An image forming apparatus according to claim 12, further comprising:

an accommodating device for accommodating sheets, wherein said sheet feeding device contacts the accommodating device.

16. The image forming apparatus according to claim 11, wherein said first driving power transferring device comprises:

a clutch including a plate, and a permanent magnet generating magnetic force that draws the plate to the permanent magnet, when no electrical power is supplied to the exciting coil, to cause the driving power to be transferred from the driving device to the sheet feeding device.

17. The image forming apparatus according to claim 16, wherein said sheet feeding device comprises:

a shaft on which the clutch is arranged; and a roller arranged on the shaft to feed the sheet from the sheet device to the timing device.

* * * * *